US009618171B2

(12) United States Patent
Sepkhanov et al.

(10) Patent No.: US 9,618,171 B2
(45) Date of Patent: Apr. 11, 2017

(54) LIGHT-EMITTING ACOUSTIC BUILDING ELEMENT

(71) Applicant: PHILIPS LIGHTING HOLDING B.V., Eindhoven (NL)

(72) Inventors: Ruslan Akhmedovich Sepkhanov, Eindhoven (NL); Maarten Marinus Johannes Wilhelmus Van Herpen, Heesch (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 201 days.

(21) Appl. No.: 14/391,398

(22) PCT Filed: Apr. 4, 2013

(86) PCT No.: PCT/IB2013/052699
§ 371 (c)(1),
(2) Date: Oct. 9, 2014

(87) PCT Pub. No.: WO2013/153491
PCT Pub. Date: Oct. 17, 2013

(65) Prior Publication Data

US 2015/0109765 A1 Apr. 23, 2015

Related U.S. Application Data

(60) Provisional application No. 61/623,103, filed on Apr. 12, 2012.

(51) Int. Cl.
*F21S 8/00* (2006.01)
*F21S 8/04* (2006.01)
(Continued)

(52) U.S. Cl.
CPC ..... *F21S 8/046* (2013.01); *E04B 1/86* (2013.01); *E04B 9/32* (2013.01); *F21V 11/14* (2013.01);
(Continued)

(58) Field of Classification Search
CPC ..... E04B 1/86; E04B 9/32; E04B 2001/8433; E04B 2001/848; E04B 2001/8495;
(Continued)

(56) References Cited

U.S. PATENT DOCUMENTS 3,209,142 A 9/1965 Michel et al.
6,615,951 B1 * 9/2003 Boutin ..... E04B 1/86 181/293
(Continued)

FOREIGN PATENT DOCUMENTS

CN 201575363 U 9/2010
CN 201748229 U 2/2011
(Continued)

*Primary Examiner* — Laura Tso
*Assistant Examiner* — Naomi M Wolford

(57) ABSTRACT

The present invention relates to a light-emitting building element (1) comprising a plurality of solid-state light sources (19); and a sound-absorbing element (10) having an optically reflective side (15). The sound-absorbing element (10) is arranged such that the optically reflective side (15) faces the plurality of solid-state light sources (19), and comprises a plurality of holes (17) through the sound-absorbing element from the optically reflective side to an opposite side (16) of the sound-absorbing element. Each of the holes (17) is configured such that a projection of the hole in a plane parallel to the sound-absorbing element (10) is smaller than a smallest area of a cross-section of the hole (17), the cross-section being perpendicular to a normal of the sound-absorbing element (10). By configuring the ventilation holes in this manner, hot air can pass unhindered through the holes, while at least a fraction of the light hitting
(Continued)

the hole on the optically reflective side of the sound-absorbing element will be prevented from passing through the sound-absorbing element.

15 Claims, 3 Drawing Sheets

(51) Int. Cl.

| | |
|---|---|
| ***E04B 1/86*** | (2006.01) |
| ***E04B 9/32*** | (2006.01) |
| ***F21V 11/14*** | (2006.01) |
| ***F21V 33/00*** | (2006.01) |
| ***F21V 29/83*** | (2015.01) |
| *F21Y 101/00* | (2016.01) |
| *F21Y 105/10* | (2016.01) |
| *F21Y 115/10* | (2016.01) |

(52) U.S. Cl.
CPC ..... *F21V 29/83* (2015.01); *F21V 33/006* (2013.01); *F21Y 2101/00* (2013.01); *F21Y 2105/10* (2016.08); *F21Y 2115/10* (2016.08); *Y10T 29/49002* (2015.01)

(58) Field of Classification Search
CPC ..... Y10T 29/49002; F21Y 2101/02; F21Y 2105/001; F21Y 2115/10; F21Y 2101/00; F21Y 2105/10; F21S 8/046; F21V 11/14; F21V 29/83; F21V 33/006; G10K 11/168
USPC ..... 181/289, 290, 293; 362/148, 404, 362/249.02, 800, 147
See application file for complete search history.

(56) References Cited

U.S. PATENT DOCUMENTS

| | | | | |
|---|---|---|---|---|
| 7,303,305 | B2 | 12/2007 | Kennedy | |
| 7,482,632 | B2 | 1/2009 | Lu et al. | |
| 7,798,684 | B2 | 9/2010 | Boissevain | |
| 9,194,124 | B2 * | 11/2015 | Johnson | E04B 9/32 |
| 2008/0211369 | A1 | 9/2008 | Zhang et al. | |
| 2008/0285271 | A1 | 11/2008 | Roberge et al. | |
| 2010/0060130 | A1 | 3/2010 | Li | |
| 2011/0090671 | A1 | 4/2011 | Bertram et al. | |
| 2011/0109217 | A1 | 5/2011 | Kang et al. | |
| 2011/0228529 | A1 | 9/2011 | Patel et al. | |
| 2012/0014098 | A1 | 1/2012 | Breidenassel et al. | |

FOREIGN PATENT DOCUMENTS

| | | | |
|---|---|---|---|
| CN | 201885113 | U | 6/2011 |
| CN | 201892120 | U | 7/2011 |
| DE | 202010003644 | U1 | 8/2010 |
| WO | 2006008070 | A1 | 1/2006 |

* cited by examiner

LIGHT-EMITTING ACOUSTIC BUILDING ELEMENT

CROSS-REFERENCE TO PRIOR APPLICATIONS

This application is the U.S. National Phase application under 35 U.S.C. §371 of International Application No. PCT/IB2013/052699, filed on Apr. 4, 2013, which claims the benefit of U.S. Provisional Patent Application No. 61/623,103, filed on Apr. 12, 2012. These applications are hereby incorporated by reference herein.

FIELD OF THE INVENTION

The present invention relates to a light-emitting building element and to a method of manufacturing such a light-emitting building element.

BACKGROUND OF THE INVENTION

In modern buildings, the building elements used, for example in the ceiling, need to perform various functions in relation to, for example, acoustics, lighting, ventilation etc. To reduce the number of building elements required to perform various functions, it would be desirable to combine several functions in the same building element.

SUMMARY OF THE INVENTION

In view of the above-mentioned and other drawbacks of the prior art, a general object of the present invention is to provide a building element that provides both acoustic functionality and lighting.

According to a first aspect of the present invention there is provided a light-emitting building element comprising: a plurality of solid-state light sources; and a sound-absorbing element having an optically reflective side, the sound-absorbing element being arranged such that the optically reflective side faces the plurality of solid-state light sources, wherein the sound-absorbing element comprises a plurality of holes through the sound-absorbing element from the optically reflective side to an opposite side of the sound-absorbing element, essentially each of the holes being configured such that a projection of the hole in a plane parallel to the sound-absorbing element is smaller than a smallest area of a cross-section of the hole, the cross-section being perpendicular to a normal of the sound-absorbing element.

The expression "essentially each of the holes" is meant to be understood such that sound absorbing elements comprising one or more holes with an incidentally, unintended deviation from the desired shape of a hole are considered to be comprised in the scope of the claims.

Solid state light sources are light sources in which light is generated through recombination of electrons and holes. Examples of solid state light sources include LEDs and semiconductor lasers.

The sound-absorbing element may advantageously be made of a material capable of absorbing sound waves, such as a porous material. One example of such a porous material is glass wool.

Furthermore, the sound-absorbing element may advantageously be provided as a substantially sheet-shaped sound-absorbing element.

In the context of the present application, one or more properties of holes through the sound-absorbing element is/are defined in relation to a normal of the sound-absorbing element. It should be understood that, for a particular hole, the normal referred to is a local normal to the surface of the sound-absorbing layer at the location of the particular hole. For a planar sound-absorbing element, the normal is the same across the sound-absorbing element. Should the sound-absorbing element, however, be non-planar (for example curved) then the local normal will vary across the sound-absorbing element.

The present invention is based on the realization that lighting and acoustic functionality (sound absorption) can be achieved in a compact and energy-efficient manner by arranging a plurality of solid-state light sources, such as light-emitting diodes (LEDs) on an optically reflective side of a sound-absorbing element. Due to the optically reflective side of the sound-absorbing element, the sound-absorbing element, in addition to its sound-absorbing function, serves as a light reflector that directs light towards the user.

The light-emitting building element may also be provided with a light-transmissive layer arranged such that the solid-state light sources are provided between the optically reflective side of the sound-absorbing element and the light-transmissive layer. In such embodiments, the optically reflective side allows for reuse of the light reflected back from the light-transmissive layer. This increases the chance for light to exit through the light-transmissive layer, and therefore improves the optical efficiency of the light-emitting building element.

Since the optical efficiency and the lifetime of a solid-state light source degrade as the temperature increases, a general issue with solid-state light sources, such as LEDs, is the extraction of heat. Even though solid-state light sources are more efficient than traditional light sources, such as CCFLs or incandescent lamps, they require a better cooling because traditional sources irradiate the greater part of the generated heat in the form of infrared radiation in a directed beam together with the visible light. An LED, however, emits no directed infrared radiation. Additionally, due to its compactness, an LED itself is a smaller heat sink than a traditional source, which leads to higher local temperatures.

Furthermore, materials suitable for use in a sound-absorbing element typically exhibit a relatively low thermal conductance, which means that it may not be sufficient to rely on heat transfer occurring by means of heat conduction through the sound-absorbing element.

The present inventors have found that improved cooling of the solid-state light sources substantially without any reduction in the performance of the light-emitting building element can be achieved by providing the sound-absorbing element with a plurality of through-going ventilation holes, which do not go straight through the sound-absorbing element but which are configured such that a projection of each hole in a plane parallel to the sound-absorbing element is smaller than a smallest area of a cross-section of the hole. In this way, an effective channel area for air will be smaller than an effective passage for light. This means that improved cooling can be achieved without a corresponding loss of light through the ventilation holes. By configuring the ventilation holes in this manner, hot air can pass unhindered through the holes, while at least a fraction of the light hitting the hole on the optically reflective side of the sound-absorbing element will be prevented from passing through the sound-absorbing element. For example, each hole may exhibit an offset between the openings on the opposite sides of the sound-absorbing element.

For some hole configurations, the provision of ventilation holes may result in a reduction in the total reflectance of the optically reflective side of the sound-absorbing side of the sound-absorbing element. However, such a reduction may be more than compensated by the increased efficiency of the solid-state light sources brought about by the reduction in temperature due to the flow of air past the solid-state light sources.

In order not to unnecessarily obstruct the flow of air through the thus perforated sound-absorbing element, the above-mentioned first opening and second opening of each hole may be of substantially the same size.

Moreover, the light-emitting building element may advantageously be provided with at least one air inlet arranged in such a way that air passing from the air inlet to the plurality of holes through the sound-absorbing element comes into contact with the solid-state light sources.

The holes through the sound-absorbing element may, for example, be provided as slanted holes that each form an angle with respect to the normal of the sound-absorbing element. This will result in an offset in a direction perpendicular to the normal of the sound-absorbing element between the first opening and the second opening.

According to various embodiments of the light-emitting building element according to the present invention, the sound-absorbing element may comprise a first layer having a first hole pattern, a second layer having a second hole pattern and a third layer having a third hole pattern, the second layer being arranged between the first layer and the third layer.

Providing such a layered sound-absorbing element may facilitate the formation of a hole configuration with the desired offset between the above-mentioned first opening and second opening of the hole.

In particular, the holes may be formed through conventional hole-making techniques resulting in holes that are substantially perpendicular to the sound-absorbing member. Such hole-making techniques include, for example, punching, drilling, laser machining etc. Alternatively, or in combination therewith, the holes may be slanted as discussed above.

Accordingly, the first hole pattern may comprise a plurality of holes being perpendicular to the first layer, the second hole pattern may comprise a plurality of holes being perpendicular to the second layer, and the third hole pattern may comprise a plurality of holes being perpendicular to the third layer.

Furthermore, the first hole pattern may be substantially the same as the second hole pattern and the third hole pattern, at least in respect of an arrangement of holes in the hole patterns. It should be understood that any one of the layers may comprise further holes in addition to those arranged in the above-mentioned hole patterns. Moreover, the holes in the different layers may be of different sizes. Also holes within a particular hole pattern may be of different sizes. For periodic hole patterns, a pitch of the first hole pattern may be substantially equal to a pitch of the second hole pattern and a pitch of the third hole pattern.

With substantially the same hole patterns in the different layers, the sound-absorbing element can be manufactured in a convenient manner, which will be further described below in connection with the second aspect of the present invention.

According to various embodiments, furthermore, holes in the second layer may be bigger than holes in the first layer and holes in the third layer. This provides for convenient manufacturing of a sound-absorbing element exhibiting substantially no overlap between the first opening on the optically reflective side of the sound-absorbing element and the second opening on the opposite side of the sound-absorbing element.

The first hole pattern may advantageously be offset from said second hole pattern in a first direction in a plane parallel to said sound-absorbing element and said third hole pattern may be offset from said second hole pattern in a second direction in a plane parallel to said sound-absorbing element, said second direction being different from said first direction. For example, the second direction may be opposite to the first direction.

To provide for improved lighting efficiency, each of the holes may advantageously have a reflective inner surface, such that light that enters the ventilation holes can be at least partly reflected out of the holes again to exit the light-emitting building element through the light-transmissive layer.

According to various embodiments, the offset between the first opening and the second opening of each hole may be such that a projection of the hole in a plane parallel to the sound-absorbing element is smaller than one half of a cross-sectional area of the hole.

Furthermore, the holes may be arranged in a hole pattern and the solid-state light sources may be arranged in a light-source pattern that has substantially the same configuration as the hole pattern. By virtue thereof, an efficient flow of air past each light source may be achieved.

The light sources may advantageously be aligned with the holes, so that each light source is arranged directly below a ventilation hole.

Various embodiments of the light-emitting building element according to the present invention may advantageously be comprised in a light-emitting acoustic tile for mounting in a ceiling, further comprising a structure for allowing the light-emitting building element to be attached to the ceiling such that the light-transmissive layer of the light-emitting building element faces away from the ceiling.

According to a second aspect of the present invention, there is provided a method of manufacturing a light-emitting building element, comprising the steps of: providing a sound-absorbing element having an optically reflective side, wherein the sound-absorbing element comprises a plurality of holes through the sound-absorbing element from the optically reflective side to an opposite side of the sound-absorbing element, each of the holes being configured such that a projection of the hole in a plane parallel to the sound-absorbing element is smaller than a smallest area of a cross-section of the hole, the cross-section being perpendicular to a normal of the sound-absorbing element; arranging a light-transmissive layer in parallel with the sound-absorbing element so as to face the optically reflective side of the sound-absorbing element; and providing a plurality of solid-state light sources between the reflective side of the sound-absorbing element and the light-transmissive layer.

According to various embodiments, the step of providing the sound-absorbing member may comprise the steps of providing a first sheet having a first hole pattern, a second sheet having a second hole pattern and a third sheet having a third hole pattern; stacking the first sheet, the second sheet and the third sheet in such a way that holes in the first pattern are offset from holes in the third pattern in the direction perpendicular to the normal of the sound-absorbing element and holes in the second pattern interconnect holes in the first pattern and the third pattern to form open passages through the sound-absorbing member; and joining the first sheet and the third sheet to the second sheet.

In this way, the holes can be made in the different sheets using well-established and rational hole-making techniques, and the desired offset hole configuration can then be achieved through a simple alignment step, which may, for example, be conveniently carried out using a simple fixture or similar.

Further variations and advantages of this second aspect of the present invention are largely analogous to those provided above in connection with the first aspect of the invention.

BRIEF DESCRIPTION OF THE DRAWINGS

These and other aspects of the present invention will now be described in more detail, with reference to the appended drawings showing currently preferred embodiments of the invention, wherein.

DESCRIPTION OF A PREFERRED EMBODIMENT OF THE PRESENT INVENTION

In the following description, the present invention is mainly described with reference to an acoustic ceiling panel with integrated LED-lighting.

It should, however, be noted that this by no means limits the scope of the invention, which is equally applicable to other applications, such as light-emitting wall panels etc.

Figure 1:
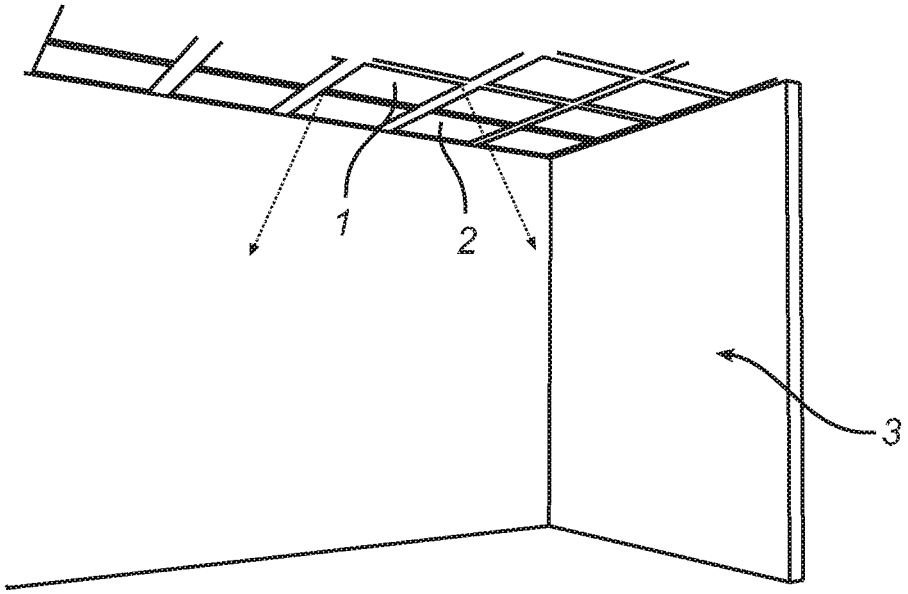
FIG. 1 schematically shows an exemplary application for an exemplary embodiment of the light-emitting building element according to the present invention.

FIG. 1 schematically illustrates an exemplary application for embodiments of the light-emitting building element according to the present invention, in the form of a light-emitting acoustic ceiling panel 1 arranged among other, conventional, ceiling panels 2 in a room 3. The configuration of the light-emitting building element 1 will now be described with reference to FIG. 2.

Figure 2:
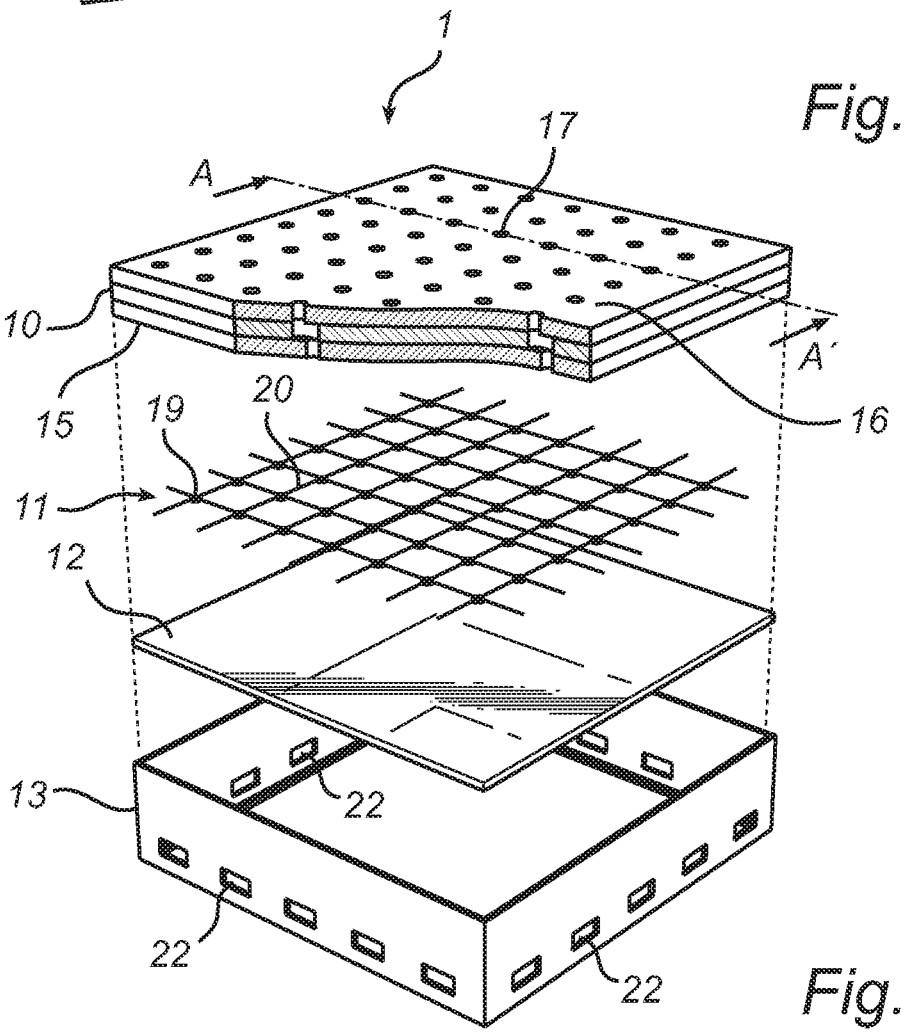
FIG. 2 is an exploded perspective view of the light-emitting building element in FIG. 1.

Referring to FIG. 2, the light-emitting building element 1 comprises a sound-absorbing element 10, a light-emitting module 11, a light-transmissive layer 12, and a frame 13 for holding the light-emitting building element 1 together.

The sound-absorbing element 10 is made from a sound-absorbing material, such as glass wool. The sound-absorbing element 10 has an optically reflective side 15 facing the light-emitting module 11 and an outer side 16 facing away from the light-emitting module 11. As is schematically indicated in FIG. 2, the sound-absorbing element 10 further comprises a plurality of holes 17 through the sound-absorbing element 10 from the optically reflective side 15 to the outer side 16. The inner surface of each hole 17 has also been made optically reflective, and there is an offset between the opening of each hole 17 on the optically reflective side 15 and the opening of each hole 17 on the outer side 16 facing away from the light-emitting module 11. The configuration of the holes 17 will be explained in greater detail below with reference to FIG. 3.

With continued reference to FIG. 2, the light-emitting module 11 comprises a plurality of solid-state light sources, here in the form of LEDs 19, arranged on a grid-shaped carrier 20. As an alternative to the grid-shaped carrier 20, other carriers may be used as long as light and sound waves can pass through the carrier. For example, a perforated printed circuit board could be used as a carrier.

The light-transmissive layer 12 is schematically shown in FIG. 2 as a light-diffusing sheet, which may, for example, be made of a textile material or paper. It should, however, be noted that the light-transmissive layer 12 may be configured to perform further functions or functions other than diffusing the light emitted by the LEDs 19. For example, the light-transmissive layer 12 may be a prism sheet for controlling the spatial distribution of the light output by the light-emitting building element 1. It may, for example, be desirable to avoid glare.

Finally, the light-emitting building element 1 comprises a frame 13 for fixing the relative positions of the sound-absorbing element 10, the light-emitting module and the light-transmissive layer 12 and for holding the light-emitting building element 1 together. The frame 13 may be metallic or may be made of a suitable plastic material. As is schematically illustrated in FIG. 2, the frame 13 may comprise one or several air inlets 22 for allowing air to enter the light-emitting building element 1 to cool the LEDs 19. The flow of air through the light-emitting building element 1 when in operation will be discussed below with reference to FIG. 3.

Some aspects of the light-emitting building element 1 in FIG. 2, such as the configuration of the holes 17 in the sound-absorbing element 10 and the flow of air through the light-emitting building element 1, will now be described with reference to FIG. 3, which is a schematic cross-sectional view of the light-emitting building element 1 in FIG. 2, taken along the line A-A' in FIG. 2.

Figure 3:
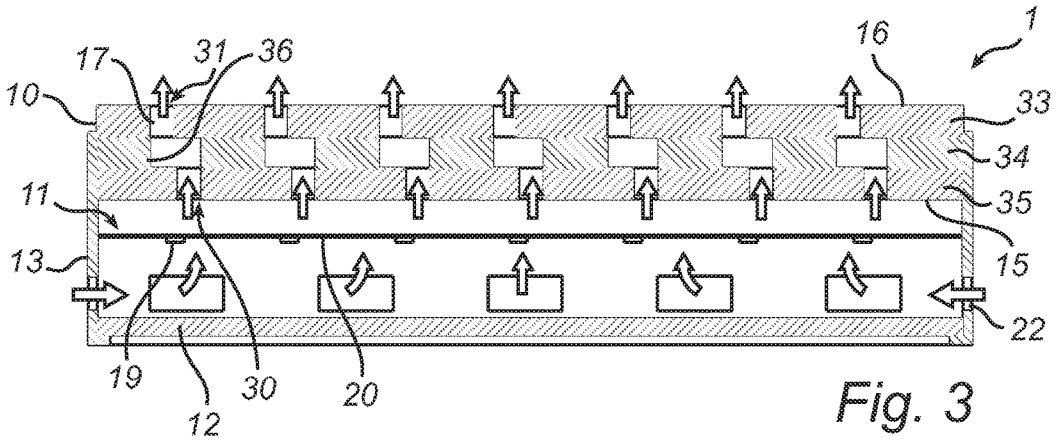
FIG. 3 is a cross-sectional view of the light-emitting building element in FIG. 2.

As can be seen in FIG. 3, the first opening 30 of each hole 17 on the optically reflective side 15 of the sound-absorbing member 10 and the second opening 31 of each hole 17 on the outer side 16 of the sound-absorbing member 10 are offset in relation to each other in a direction perpendicular to a normal of the sound-absorbing member 10. In the exemplary embodiment in FIG. 3, there is no overlap between the first opening 30 and the second opening 31, or, in other words, there is no projection of the hole 17 in a plane perpendicular to the sound-absorbing member 10. This means that no light will be able to escape directly from the interior of the light-emitting building element 1 through the holes 17.

In the example embodiment of FIG. 3, the sound-absorbing member 10 comprises a first layer 33 having a first hole pattern, a second layer 34 having a second hole pattern and a third layer 35 having a third hole pattern. As can be understood from FIG. 3, the holes in the different layers 33-35 are offset in relation to each other, and the holes in the second layer 34 arranged between the first layer 33 and the second layer 35 are bigger in order to connect the holes in the first layer 33 with the holes in the third layer 35 to thereby allow passage of air through the combined hole 17 through the sound-absorbing member 10 while preventing or at least reducing the amount of light passing through the sound-absorbing member.

When the LEDs 19 in the light-emitting building element 1 are in operation, heat will be generated. This heat will cause heated air to rise and pass through the holes 17 in the sound-absorbing element. This will in turn cause air to be sucked into the interior of the light-emitting building element 1 through the air inlets 22 provided in the frame 13.

The air inlets are arranged at a lower level than the LEDs 19, when the light-emitting building element 1 is used as a ceiling panel, which means that the air flowing from the inlets 22 to the holes 17 in the sound-absorbing member 10 will pass the LEDs 19 so that the LEDs 19 are cooled by the flow of air. The flow of air through the light-emitting building element 1 is schematically illustrated by the arrows in FIG. 3.

Since the inner surface 36 of each hole, as well as the optically reflective inner surface 15 of the sound-absorbing member 10 have been made optically reflective, also light that enters the ventilation holes 17 will, to a great degree, be reflected towards the light-transmissive layer 12 and exit the light-emitting building element 1. The inner surface of each hole 17 and the inner surface 15 of the sound-absorbing member 10 may, for example, be made optically reflective through a suitable coating, for example white paint.

Figure 4:
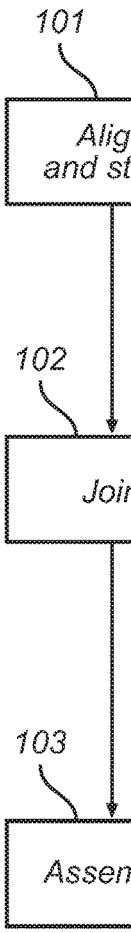
FIG. 4 is a flow-chart for illustration of an exemplary method according to an embodiment of the invention.
Figure 5A:
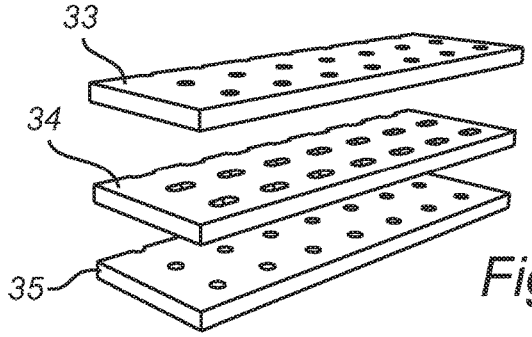
FIGS. 5*a-c* schematically illustrate the result of the corresponding method steps of FIG. 4.
Figure 5B:
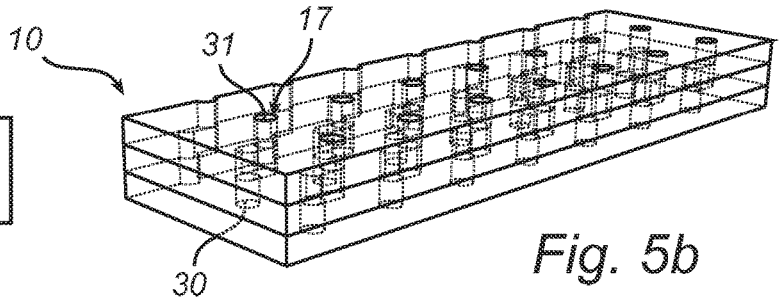
Figure 5C:
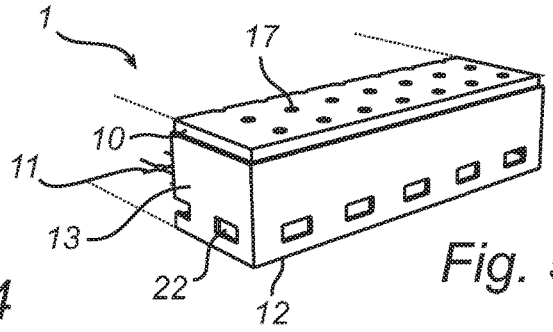

Having described an exemplary configuration of the light-emitting building element 1 according to an embodiment of the present invention, an exemplary method of manufacturing such a light-emitting building element 1 will now be described with reference to the flow chart in FIG. 4 and the schematic drawings in FIGS. 5*a-c*.

In the first step 101, first 33, second 34 and third 35 sound-absorbing material sheets are aligned and stacked. As is schematically shown in FIG. 5*a*, the three sound-absorbing material sheets have hole patterns with the same hole configuration, except that the holes in the second sound-absorbing material sheet 34 are bigger than the holes in the first sound-absorbing material sheet 33 and the third sound-absorbing material sheet 35. The three sound-absorbing material sheets 33-35 are aligned in such a way that the holes in the first sound-absorbing material sheet 33 and the holes in the third sound-absorbing material sheet 35 are offset relative each other and interconnected by the holes in the second sound-absorbing material sheet 34.

In the subsequent step 102, the first 33, second 34 and third 35 sound-absorbing material sheets are joined, for example by gluing, to form a sound-absorbing element 10 with ventilation holes 17 passing through the sound-absorbing element 10 as described above with reference to FIGS. 2 and 3. In the final step 103, the light-emitting building element 1 is completed through the assembly of the above-described parts comprised in the light-emitting building element 1, that is, the sound-absorbing element 10, the light-emitting module 11, the light-transmissive layer 12 and the frame 13.

Figure 6A:
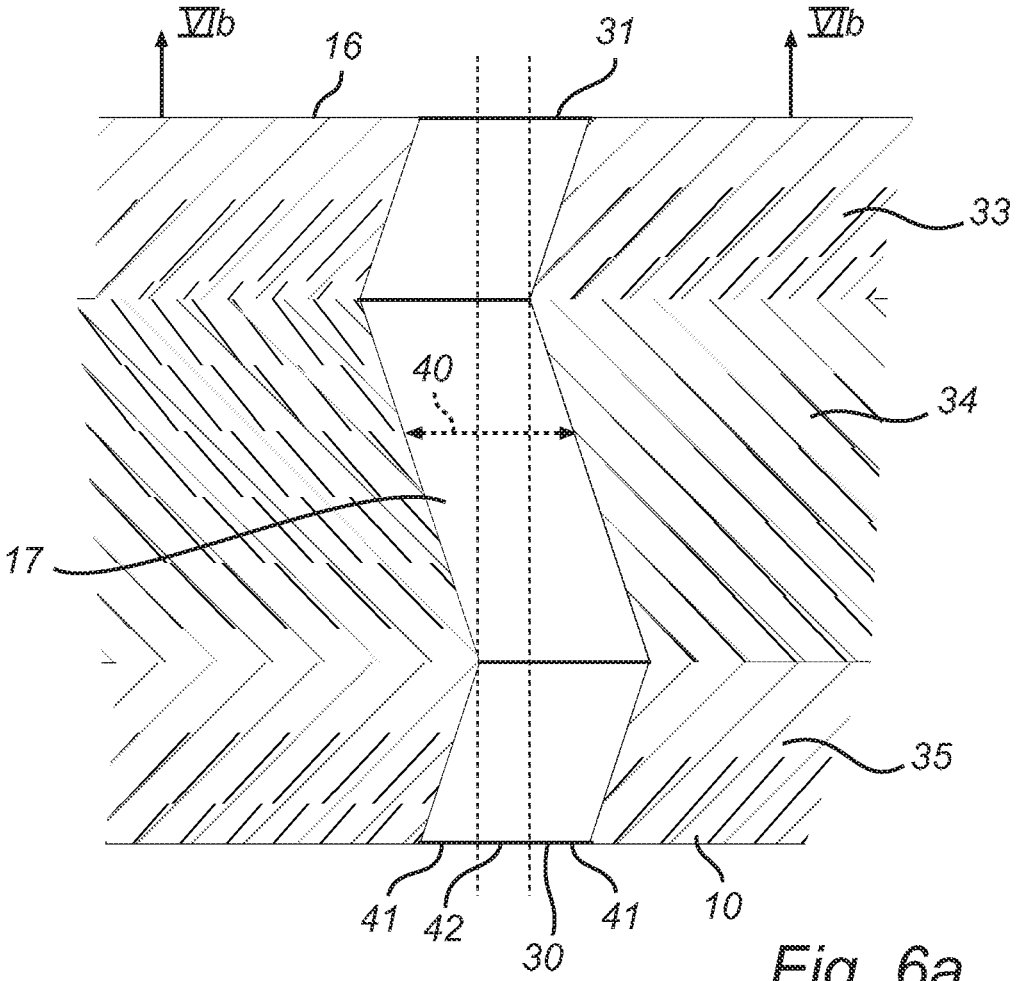
FIGS. 6*a-b* show a cross-sectional view and a top view, respectively, of a part of a sound absorbing element according to an embodiment of the invention.
Figure 6B:
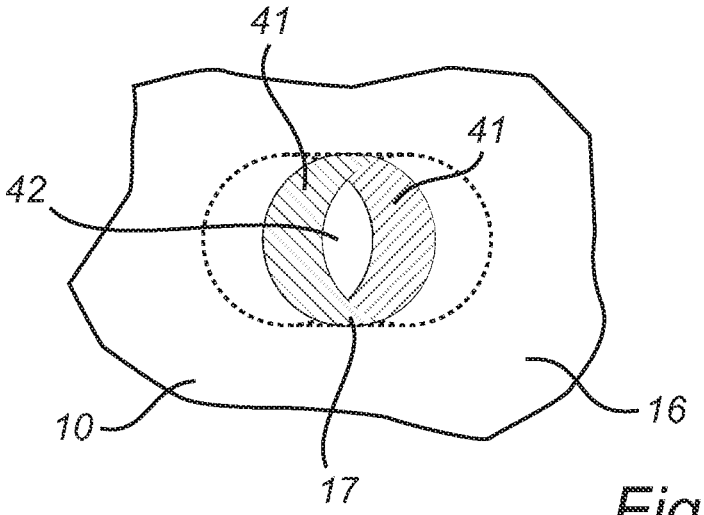

In the example embodiment of FIG. 6*a*, a part of a sound-absorbing member 10 is shown in cross section. The sound-absorbing member comprises a first layer 33 having first holes, a second layer 34 having second holes and a third layer 35 having third holes. Alternatively, the sound absorbing member 10 of FIG. 6*a* could be composed of only two layers. As clearly shown in FIG. 6*a*, the holes in the different layers 33-35 are slanted and arranged in relation to each other to form one continuous hole 17 which has a same cross sectional area 40 at any location. The slant of the hole in the layer 34 is in another direction than the slant of the holes in the layers 33 and 35, and is such that the first opening 30 and the second opening 31, when projected in a plane parallel to the sound-absorbing member, are not mutually shifted but mutually fully overlap while the cross sectional area 40 of the hole is reduced by a shield area 41 to create a direct through-view area 42, as is shown in the top view of the outer side 16 in FIG. 6*b*. The direct through-view area is significantly smaller than the cross sectional area. Thus, a practically unobstructed passage of air through the combined hole 17 through the sound-absorbing member 10 is enabled while simultaneously a significant reduction is attained in the amount of light passing through the sound-absorbing member.

Additionally, variations to the disclosed embodiments can be understood and effected by the skilled person in practicing the claimed invention, from a study of the drawings, the disclosure, and the appended claims. For example, different hole sizes and patterns may be provided and/or a thin metallic coating may be formed on the inner surface of the holes.

In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A light-emitting building element, comprising:

a plurality of solid-state light sources; and a sound-absorbing element having an optically reflective side, said sound absorbing element being arranged such that said optically reflective side faces said plurality of solid-state light sources, wherein said sound-absorbing element comprises a plurality of holes through said sound-absorbing element from said optically reflective side to an opposite side of the sound-absorbing element, essentially each of said holes being configured such that upon projection of said hole in a plane parallel to said sound-absorbing element a direct through-view area is smaller than the smallest cross-section area of said hole, said cross-section being parallel to said sound-absorbing element, wherein essentially each of said holes has a reflective inner surface, the light-emitting building element further comprising a light-transmissive layer arranged in parallel with said sound-absorbing element, opposite said optically reflective side of the sound-absorbing element, in such a way that said solid-state light sources are provided between said light-transmissive layer and said sound-absorbing element.

2. The light-emitting building element according to claim 1, wherein essentially each of said holes is configured such that said direct through-view area is smaller than one half of the smallest cross-sectional area of said hole.

3. The light-emitting building element according to claim 2, wherein essentially each of said holes is configured such that said direct through-view area is zero, so that there is no direct view through the hole.

4. The light-emitting building element according to claim 1, wherein essentially each of said holes is configured such that a first opening of said hole on said optically reflective side of the sound-absorbing element and a second opening of said hole on said opposite side of said sound-absorbing element are offset in a direction perpendicular to a normal of the sound-absorbing element.

5. The light-emitting building element according to claim 1, wherein said sound-absorbing element comprises a first layer having a first hole pattern, a second layer having a second hole pattern and a third layer having a third hole pattern, said second layer being arranged between said first layer and said third layer.

6. The light-emitting building element according to claim 5, wherein said first hole pattern is substantially the same as said second hole pattern and said third hole pattern, at least in respect of an arrangement of holes in said hole patterns.

7. The light-emitting building element according to claim 6, wherein holes in said second layer are bigger than holes in said first layer and holes in said third layer.

8. The light-emitting building element according to claim 5, wherein said first hole pattern is offset from said second hole pattern in a first direction in a plane parallel to said sound-absorbing element and said third hole pattern is offset from said second hole pattern in a second direction in a plane parallel to said sound-absorbing element, said second direction being different from said first direction.

9. The light-emitting building element according to claim 1, wherein said holes are arranged in a hole pattern, and said solid-state light sources are arranged in a light-source pattern that has substantially the same configuration as said hole pattern.

10. The light-emitting building element according to claim 1, wherein each of said light sources is arranged to be aligned with a corresponding one of said holes along a normal to said sound-absorbing element.

11. A light-emitting acoustic tile for mounting in a ceiling, comprising the light-emitting building element according to claim 1 and a structure for allowing said light-emitting building element to be attached to the ceiling such that said light-transmissive layer of the light-emitting building element faces away from said ceiling.

12. A method of manufacturing a light-emitting building element, comprising the steps of:

providing a sound-absorbing element having an optically reflective side, wherein the sound-absorbing element comprises a plurality of holes through said sound-absorbing element from said optically reflective side to an opposite side of the sound-absorbing element, essentially each of said holes being configured such that a projection of said hole in a plane parallel to said sound-absorbing element is smaller than a smallest area of a cross-section of said hole, said cross-section being perpendicular to a normal of said sound-absorbing element, wherein essentially each of said holes has a reflective inner surface;

arranging a light-transmissive layer in parallel with said sound-absorbing element, opposite said optically reflective side of the sound-absorbing element; and providing a plurality of solid-state light sources between said reflective side of the sound-absorbing element and said light-transmissive layer.

13. The method according to claim 12, further comprising the steps of:

arranging said holes in a hole pattern, and arranging said solid-state light sources in a light-source pattern that has substantially the same configuration as said hole pattern.

14. The method according to claim 12, further comprising the step of:

arranging each of said light sources to be aligned with a corresponding one of said holes along a normal to said sound-absorbing element.

15. A method of manufacturing a light-emitting building element, comprising the steps of:

providing a sound-absorbing member having an optically reflective side, wherein the step of providing said sound-absorbing member comprises the steps of:

providing a first sheet having a first hole pattern, a second sheet having a second hole pattern and a third sheet having a third hole pattern;

stacking the first sheet, the second sheet and the third sheet in such a way that holes in said first pattern are offset from holes in said third pattern in a direction perpendicular to a normal of the sound-absorbing element and holes in said second pattern interconnect holes in said first pattern and said third pattern to form open passages through said sound-absorbing member; and joining said first sheet and said third sheet to said second sheet.

* * * * *